US005340349A

United States Patent [19]

Berg-Fernstrum

[11] Patent Number: 5,340,349

[45] Date of Patent: Aug. 23, 1994

[54] SPHERICAL TOY

[76] Inventor: Rosemary Berg-Fernstrum, W6366 W. 38th Ave., R.D. #1.25, Menominee, Mich. 49858

[21] Appl. No.: 984,497

[22] Filed: Dec. 2, 1992

[51] Int. Cl.[5] ..... A63H 33/08; A63H 33/04; A63H 33/06

[52] U.S. Cl. ..... 446/126; 446/85; 446/121; 446/901

[58] Field of Search ..... 273/DIG. 25, 30, 156, 273/157 R, 58 R, 58 A, 58 B, 58 D, 58 F, 58 K, 344, 346, 146; 446/101, 108, 114–120, 124–126; 52/81.3, 655.1; 434/276–278, 281, 298; D21/107, 204, 205

[56] References Cited

U.S. PATENT DOCUMENTS

| | | | |
|---|---|---|---|
| 3,008,719 | 11/1961 | Misko | 273/58 R |
| 3,959,937 | 6/1976 | Spunt | 52/81.3 |
| 4,812,128 | 3/1989 | Mikelsaar | 434/278 |
| 4,836,787 | 6/1989 | Boo | 446/108 |
| 5,049,105 | 9/1991 | Glickman | 446/126 |

FOREIGN PATENT DOCUMENTS

| | | | |
|---|---|---|---|
| 0295787 | 12/1988 | European Pat. Off. | 446/125 |
| 2129763 | 12/1972 | United Kingdom | 446/122 |

*Primary Examiner*—Robert A. Hafer
*Assistant Examiner*—Jeffrey D. Carlson

[57] ABSTRACT

A spherical toy formed by multiple conical-shaped members with the apexes of the cones adjacent the center of the sphere and the bases of the cones forming the outer surface of the sphere. Modifications include the use of solid or hollow cones and the use of various means of attachment of the apexes of the cones to form the core of the sphere.

4 Claims, 4 Drawing Sheets

SPHERICAL TOY

BACKGROUND OF THE INVENTION

1. Field of the Invention

The present invention relates to toys and more particularly pertains to a sphere or ball which may be easily assembled by even very young children.

2. Description of the Prior Art

The use of multiple members adapted to engage with one another to form a geometric three-dimensional figure is well-known. This art is replete with elements ranging from the old "erector sets" and "Lincoln Logs" to more complicated pieces such as illustrated in U.S. Pat. Nos. 4,789,369 and 4,792,319 which show interlocking pieces using pins, detents, clips, etc. to fasten one piece to another. Manual dexterity and in many instances great patience is required to assemble these elements, putting them outside the scope of use by young children of kindergarten age or younger.

In this respect, the toy according to the present invention substantially departs from the conventional concepts and designs of the prior art, and in so doing provides an apparatus primarily developed for the purpose of amusing young children and permitting the construction of a ball-like toy.

Therefore, it can be appreciated that there exists a continuing need for a new and improved multiple component toy which can readily be assembled by very young children without instruction. In this regard, the present invention substantially fulfills this need.

SUMMARY OF THE INVENTION

In view of the foregoing disadvantages inherent in the known types of multiple element toys now present in the prior art, the present invention provides an improved toy construction wherein simple and easy assembly is achieved. As such, the general purpose of the present invention, which will be described subsequently in greater detail, is to provide a new and improved toy which has all the advantages of the prior art multiple element toys and none of the disadvantages.

To attain this, the present invention essentially comprises a spherical toy formed by multiple conical-shaped members with the apexes of the cones adjacent the center of the sphere and the bases of the cones forming the outer surface of the sphere. Modifications include the use of solid or hollow cones and the use of various means of attachment of the apexes of the cones to form the core of the sphere.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy which has all the advantages of the prior art toys and none of the disadvantages.

It is another object of the present invention to provide a new and improved toy which may be easily and efficiently manufactured and marketed.

It is a further object of the present invention to provide a new and improved toy which is of a durable and reliable construction.

As even further object of the present invention is to provide a new and improved toy which is susceptible of a low cost of manufacture with regard to both materials and labor, and which accordingly is then susceptible of low prices of sale to the consuming public, thereby making such toys economically available to the buying public.

Still yet another object of the present invention is to provide a new and improved toy which provides in the apparatuses and methods of the prior art some of the advantages thereof, while simultaneously overcoming some of the disadvantages normally associated therewith.

Still another object of the present invention is to provide a new and improved multiple element toy.

Yet another object of the present invention is to provide a new and improved method of assembling a spherical toy or ball.

Even still another object of the present invention is to provide a new and improved spherical toy composed of multiple elements which can readily be assembled with very little manual dexterity.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
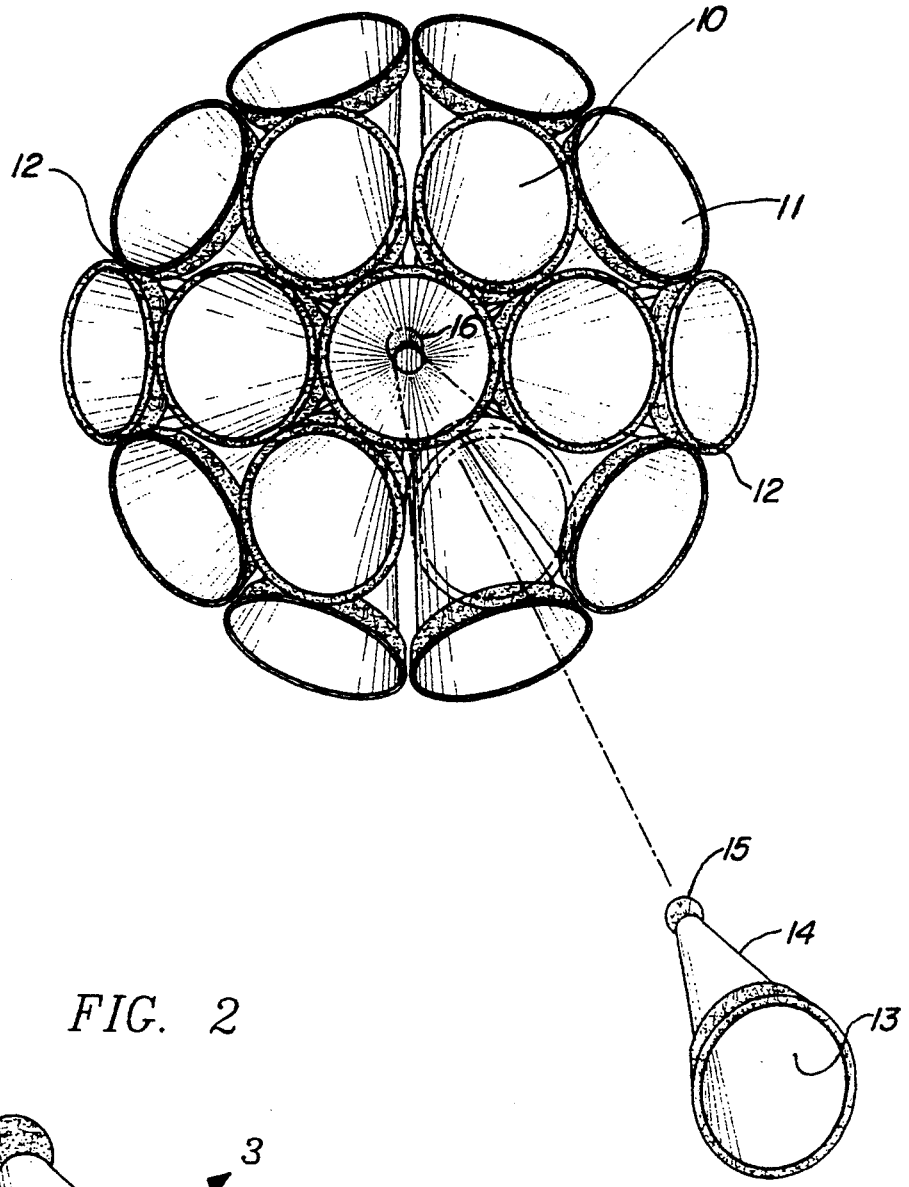
FIG. 1 is a perspective view of a preferred embodiment of the invention including an exploded view of one of the elements used in the construction of such embodiment.

With reference now to the drawings, and in particular to FIG. 1 thereof, a new and improved toy embodying the principles and concepts of the present invention and generally designated by the reference numeral 10 will be described.

More specifically, it will be noted that the surface of the sphere or ball 10 is made up of multiple circular surfaces 11 positioned adjacent one another and in the preferred embodiment with each circular surface 11 in engagement with any adjacent circular surface as at 12. The circular surfaces 11 are the bases 13 of conical elements 14 with the apex 15 of each conical element 14 extending into the interior core 16 of the sphere 10.

Figure 2:
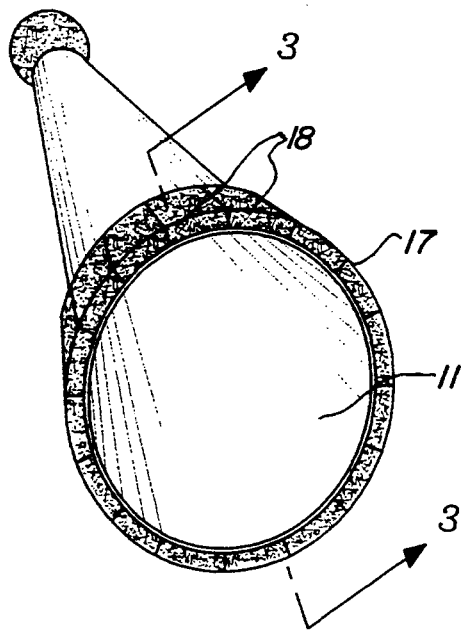
FIG. 2 is a perspective view of an element as shown in FIG. 1.

FIG. 2 shows a perspective view of one of the elements 14. In the embodiment shown in this figure and in FIG. 1, the conical element 14 has an outer ring or collar 17 positioned about the circular base surface 11 and extending inwardly a finite distance towards the apex 15. Such ring or collar serves several purposes if the conical element 14 is made of an easily deformable material such as paper or very thin plastic, the ring-shaped collar 17 will act to rigidify and prevent deformation of the element 14. Also, as illustrated in FIG. 2 the collar 17 may be composed of short segments 18. In one embodiment of the invention, alternate segments 18 will be composed of material having on the face of one segment a hook type surface and on the adjacent segments a loop type surface and so forth around the periphery of the element 14. These "Velcro" type surfaces will frictionally engage with their opposite numbers on the next adjacent collars 17 of adjacent elements 14 to cause a more rigid structure.

Figure 3:
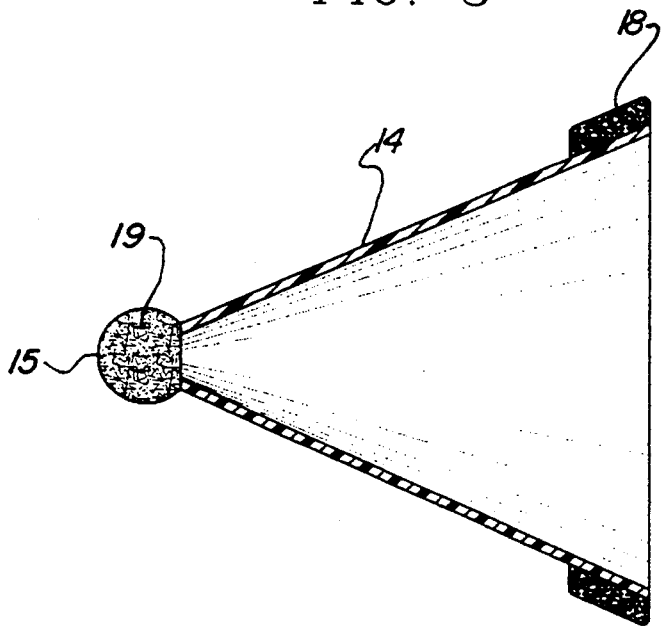
FIG. 3 is a plan view taken on section 3—3 of FIG. 2.

In FIG. 3 as well as in FIG. 2, a fastening element 19 is shown at the apex end 15 of element 14. Elements 19 are composed of a resilient material such as soft rubber, foam or the like. The surface of element 19 may carry hook-type fasteners such as mentioned above for segments 18 which will engage with a loop-covered central core as shown at 16 in FIG. 1 or the hook and loop surfaces of element 19 and core 16 may be interchanged. Alternatively, elements 19 may be adapted to be inserted into mating holes in the core 16 as shown in FIG. 6 below.

Figure 4:
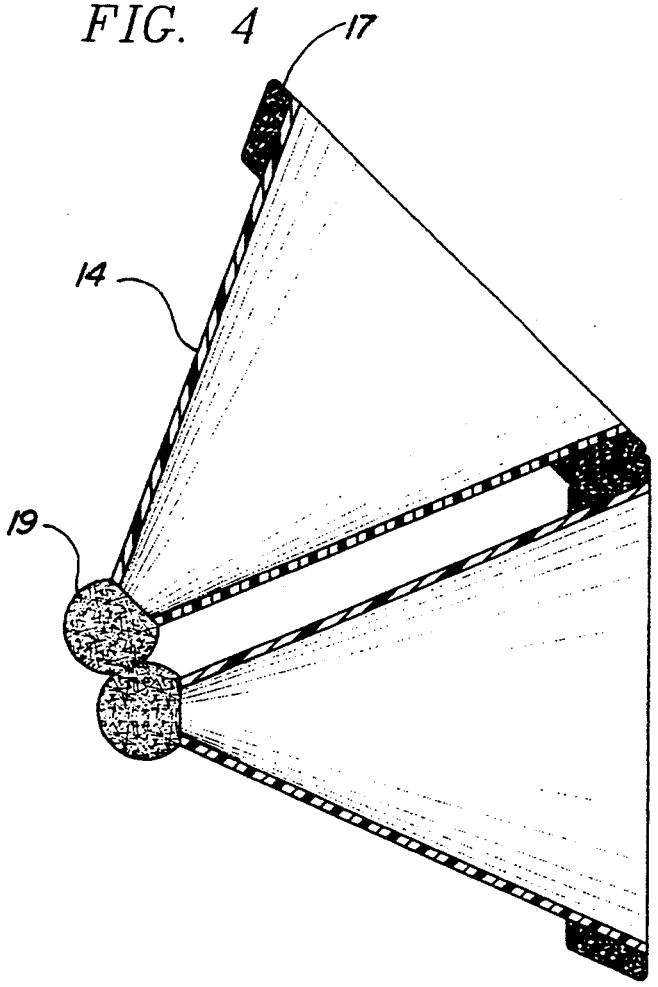
FIG. 4 is a plan view of two elements as in FIG. 3 showing their interrelationship to one another.

FIG. 4 illustrates that conical elements 14 may be used without a central core 16, with the fastening element 19 of one segment directly engaging with the corresponding element 20 of the next adjacent conical element 14.

Figure 5:
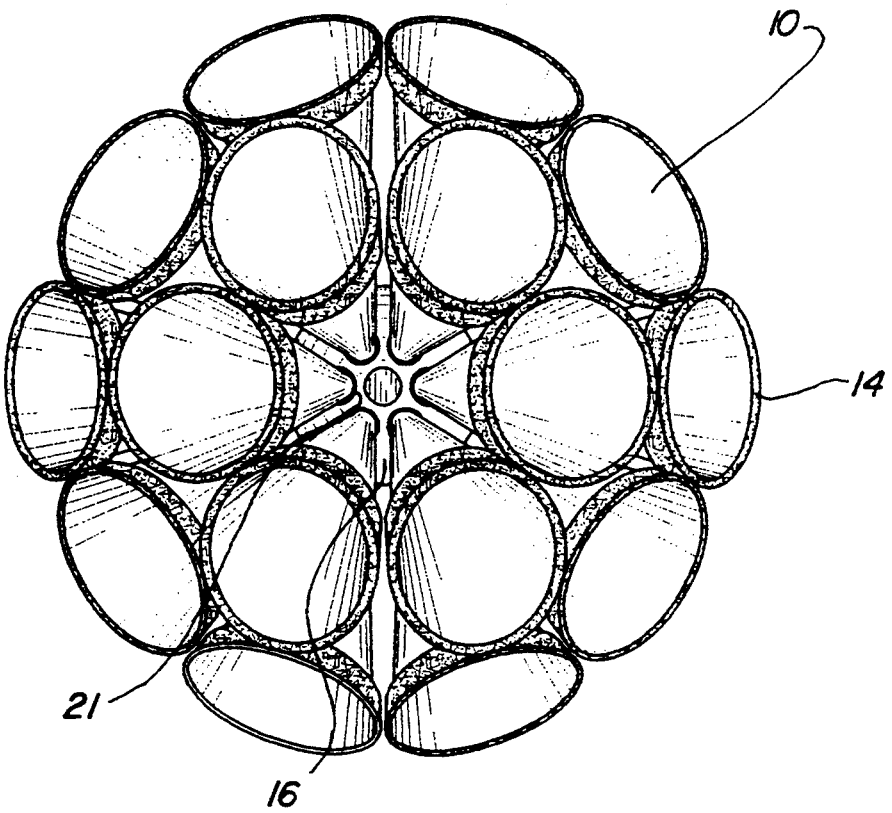
FIG. 5 is a perspective view of another embodiment of the invention.
Figure 6:
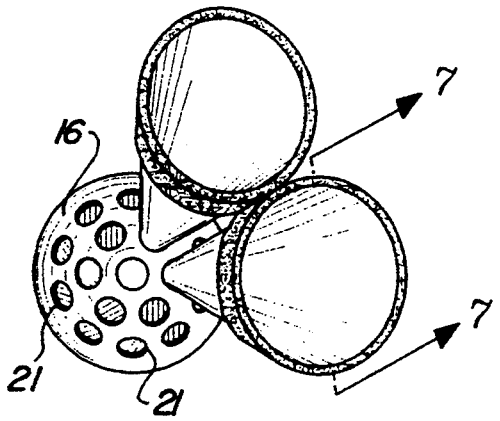
FIG. 6 illustrates one type of hub construction for the embodiment of FIGS. 1 or 5.

FIGS. 5 and 6 illustrate an embodiment of the invention utilizing a central core 16 wherein a plurality of element engaging receptacles or openings 21 are provided in spaced relationship to each other over the entire surface of core 16. These openings 21 are designed to accept the insertion of the resilient fastening elements 19 on each of the conical elements 14, thus providing a more self-sustaining or rigid structure for the sphere.

Figure 7:
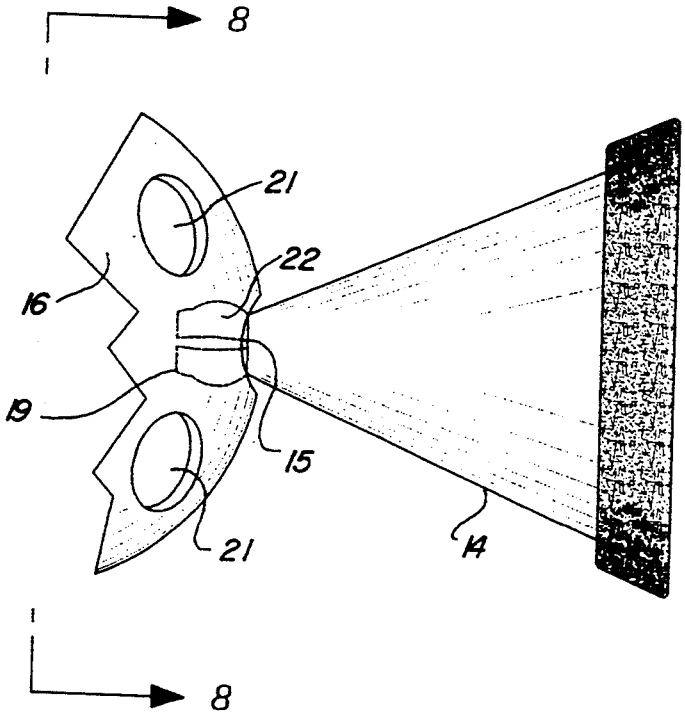
FIG. 7 is a perspective view of another element configuration.
Figure 8:
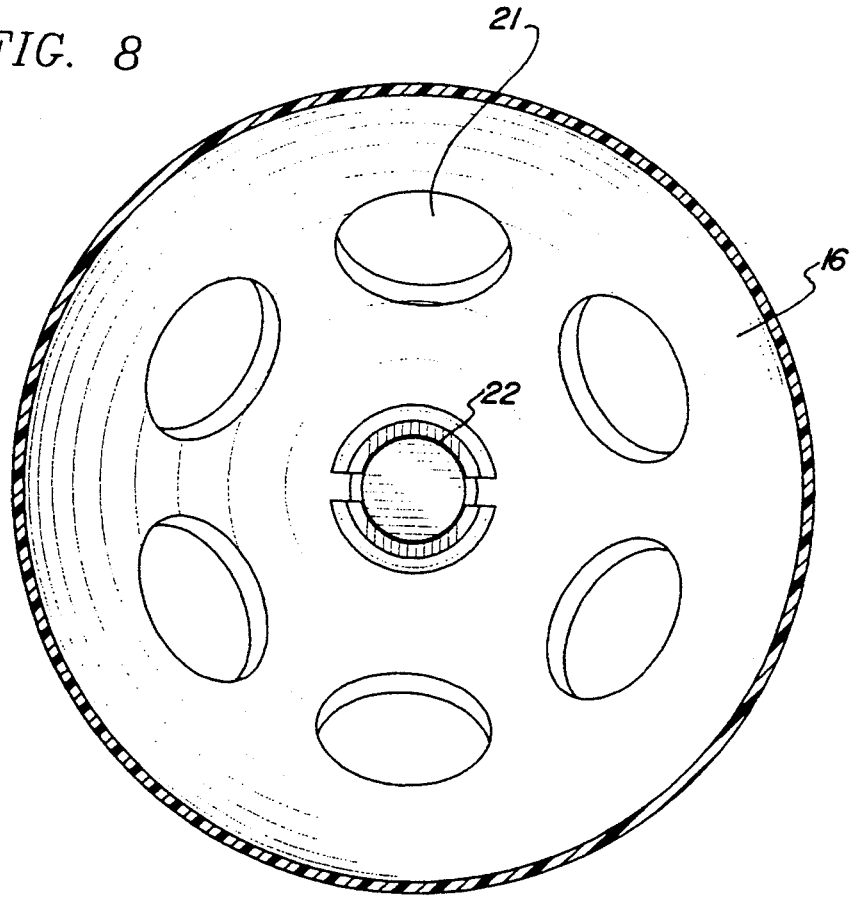
FIG. 8 is a plan view taken on line 8—8 of FIG. 7.

FIGS. 7 and 8 illustrate a further modification of the invention wherein the fastening device or element 19 as the apex end 15 of element 14 comprises a deformable and expandable clip 22 adapted to compress sufficiently to pass into and through the opening 21 in core 16 and then to expand back into its original conformation to fixedly engage elements 14 to the core 16. This configuration makes a much more permanent and rigid sphere than the use of the previously-described fastening element 19.

As to the manner of usage and operation of the present invention, the same should be apparent from the above description. Accordingly, no further discussion relating to the manner of usage and operation will be provided.

It will be understood that the material used to form the conical elements used in this invention may vary from relatively deformable materials such as paper or the like to rigid non-deformable materials such as plastics etc. In the case of the more rigid and non-deformable materials, the use of the collar 17 as described in FIG. 2 may be dispensed with and reliance placed on the fastening elements 19 as the sole means of retaining the conical elements 14 in place to form the sphere 10. Also, the conical elements 14 may be hollow and open-ended as illustrated in the drawings or, alternatively, may be hollow with a membrane or similar material to that used to form the walls of the conical element extending over the circular base surfaces 11 of the elements 14 to form a completely enclosed cone. Likewise, the conical elements may be solid provided the material used is very light weight such as foam or the like.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A playtoy assemblable into a generally spherically shaped structure comprising a multiplicity of elements, each element being of a conical shape with a circular base adapted to form part of the outer surface of said structure and an apex adapted to form part of the central core of said structure when said multiplicity of elements are assembled together to form said structure, each of said elements having an annular fastening member proximal to said circular base and a second core member fastening member at the terminus of said conical element defined by the apex thereof such that said multiplicity of conically shaped elements may be fastened to each other with the axes of said conical elements forming radii of said spherically shaped structure, the annular fastening members of adjacent elements engaging each other, the circular bases of said multiplicity of conical elements forming the outer surface of said spherical structure, and with the core member fastening members of adjacent elements confronting each other centrally of said spherical structure.

2. The playtoy of claim 1 wherein said annular fastening member comprises hook and loop material.

3. The playtoy of claim 1 further comprising a separate core member adapted to be engaged by each of said core member fastening members on each of said elements, said separate core member comprising a hollow sphere having spaced openings therein, and each of said core member fastening members comprising a spring clip adapted to be engageably received within a corresponding one of said openings.

4. The playtoy of claim 1 wherein each said core member fastening member comprises hook or loop material, and adjacent core member fastening members are adapted to engage each other to form said central core of said structure.

* * * * *